US010464277B2

(12) United States Patent
Millard

(10) Patent No.: US 10,464,277 B2
(45) Date of Patent: Nov. 5, 2019

(54) RECONFIGURABLE SCORING HEADS

(71) Applicant: F.P. Rosback Company, St. Joseph, MI (US)

(72) Inventor: Derrick Millard, Mattawan, MI (US)

( * ) Notice: Subject to any disclaimer, the term of this patent is extended or adjusted under 35 U.S.C. 154(b) by 167 days.

(21) Appl. No.: 15/012,370

(22) Filed: Feb. 1, 2016

(65) Prior Publication Data

US 2016/0144591 A1 May 26, 2016

Related U.S. Application Data

(63) Continuation-in-part of application No. 13/650,807, filed on Oct. 12, 2012, now abandoned.

(51) Int. Cl.
*B31F 1/08* (2006.01)
*B31F 1/10* (2006.01)

(52) U.S. Cl.
CPC ..... *B31F 1/10* (2013.01)

(58) Field of Classification Search
CPC ..... B31F 1/08; B31F 1/10
USPC ..... 393/396, 403
See application file for complete search history.

(56) References Cited

U.S. PATENT DOCUMENTS 3,318,206 A * 5/1967 Kuehn ..... B26D 1/245 246/187 B
4,129,065 A * 12/1978 Corse ..... B31F 1/08 493/396
4,417,883 A * 11/1983 Granger ..... B31F 1/10 493/241
4,936,818 A * 6/1990 Holohan, Jr. ..... B26D 3/085 493/396
6,572,519 B1 * 6/2003 Harris ..... B31F 1/10 493/395
7,563,220 B2 * 7/2009 Harris ..... B31F 1/10 493/160
2005/0039582 A1 * 2/2005 McCluskey ..... B26F 1/20 83/13
2008/0287276 A1 * 11/2008 Schaack ..... B31F 1/10 493/396
2011/0072951 A1 * 3/2011 Caron ..... B31F 1/10 83/886
2012/0325067 A1 * 12/2012 Yamada ..... B26F 1/384 83/346

* cited by examiner

*Primary Examiner* — Andrea L Wellington
*Assistant Examiner* — Fernando A Ayala
(74) *Attorney, Agent, or Firm* — Botkin & Hall, LLP

(57) ABSTRACT

A first hub having a first outer diameter and a second outer diameter that is larger than the first outer diameter defining a shoulder. A second hub having a first outer diameter and a second outer diameter that is larger than the first outer diameter defining a shoulder. Each hub receiving a corresponding shaft within a bore, the shafts being spaced apart and parallel. A pair of support discs hold a scoring disc having an aperture adapted for fitting over one of the hubs. The scoring disc has a raised profile that stands proud of the support discs. A grooved disc has a bore that is received on another of the hubs. The grooved disc includes a circumferential groove for receiving the raised profile when the scoring disc is aligned opposite the circumferential groove.

11 Claims, 12 Drawing Sheets

RECONFIGURABLE SCORING HEADS

BACKGROUND

Scoring modern coated papers in preparation for folding the paper is a necessary step to avoid cracking of decorative coatings that would be detrimental to the final appearance along the fold. To have a neat finished appearance requires applying stresses to the paper and coating so that it does not have stretch marks that crack the decorative coating. This kind of scoring is done with an elastomeric scoring disc. The elastomeric disc has a raised profile that pushes the paper into a receiving groove on an opposite roller. Changing the configurations of the scoring discs and receiving discs in current systems often require disassembling the scoring machine so that ends of shafts holding the scoring discs and receiving discs are exposed so that parts can be slipped over a free end. This takes considerable time to disassemble the scoring machine itself in addition to reconfiguring the scoring and receiving discs on the shafts. Ideally, reconfiguring the scoring discs and receiving disc should not require disassembly of the scoring machine itself.

SUMMARY OF THE INVENTION

The present invention relates to reconfigurable scoring heads that are installed into a scoring machine. A first hub includes a bore for receiving the first shaft within the scoring machine. The first hub has a first outer diameter and a second outer diameter that is larger than the second outer diameter and this defines a shoulder. A second hub includes a bore for receiving the second shaft within the scoring machine. The second shaft is spaced from the first shaft and parallel to the first shaft. The second hub has a first outer diameter and a second outer diameter that is larger than the first outer diameter and this defines a shoulder. A support disc has a bore adapted for fitting over one of the hubs. A second support disc has a bore for fitting over one of the hubs. A scoring disc has an aperture adapted for fitting over one of the hubs and the scoring disc is adapted for being held between the first and second support discs. The scoring disc has a outer portion that stands proud of the support discs. The scoring disc includes a slit that extends from its bore to an outermost surface of the scoring disc. This enables the scoring disc to be bent adjacent to its slit and removed from a shaft in the scoring machine without removing the shaft from the scoring machine. A grooved disc has a bore that is received on another of the hubs. The grooved disc includes a circumferential groove for receiving the raised profile when the scoring disc is aligned opposite the circumferential groove. The groove in the disc has V-shaped portions near its outer edges and a relatively deep channel within the V-shaped portion so that either side of the deep channel is flanked by the V-shaped portions.

DETAILED DESCRIPTION OF THE INVENTION

Figure 1:
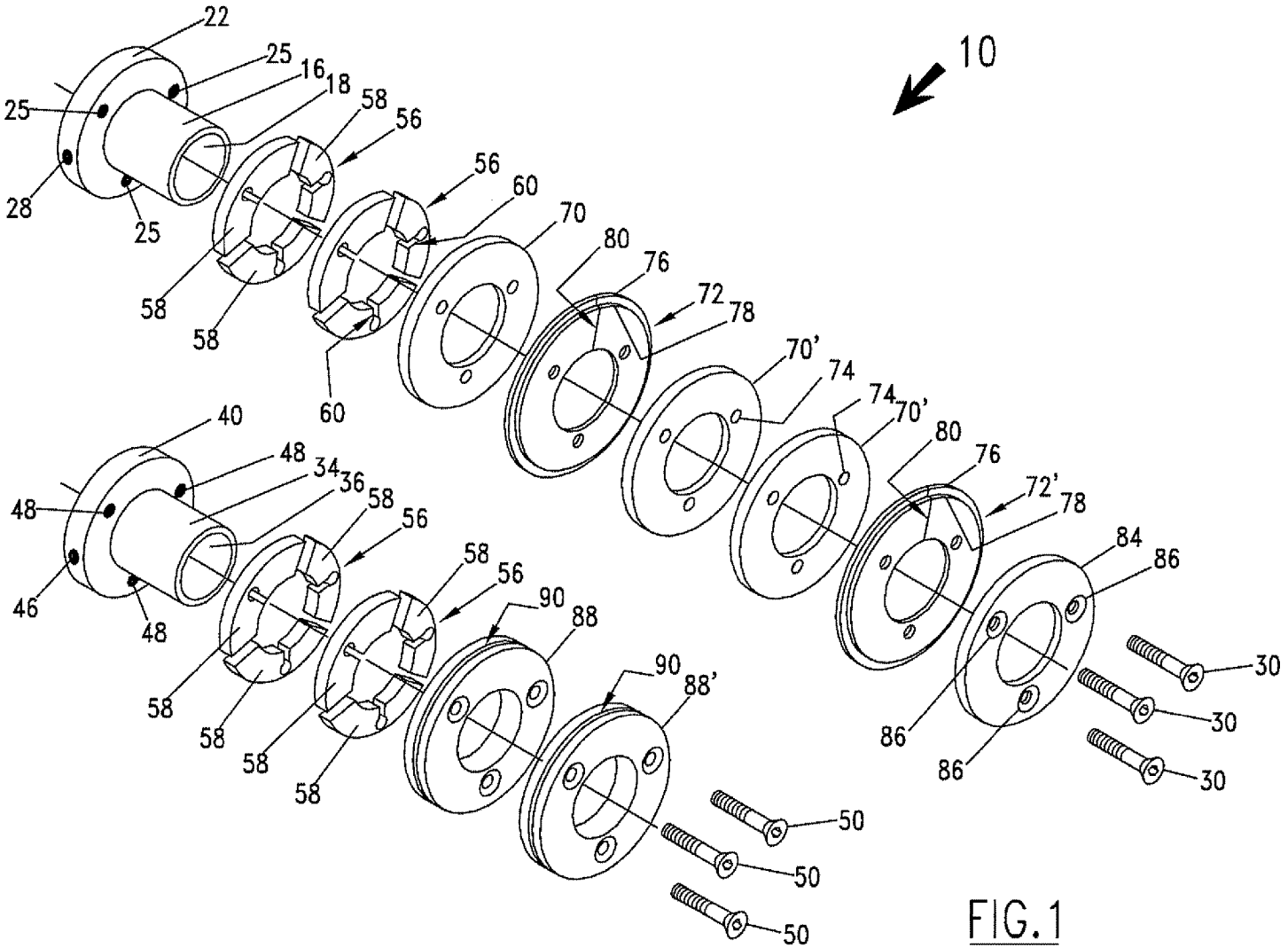
FIG. 1 is an exploded perspective view of the scoring system of the present invention.
Figure 2:
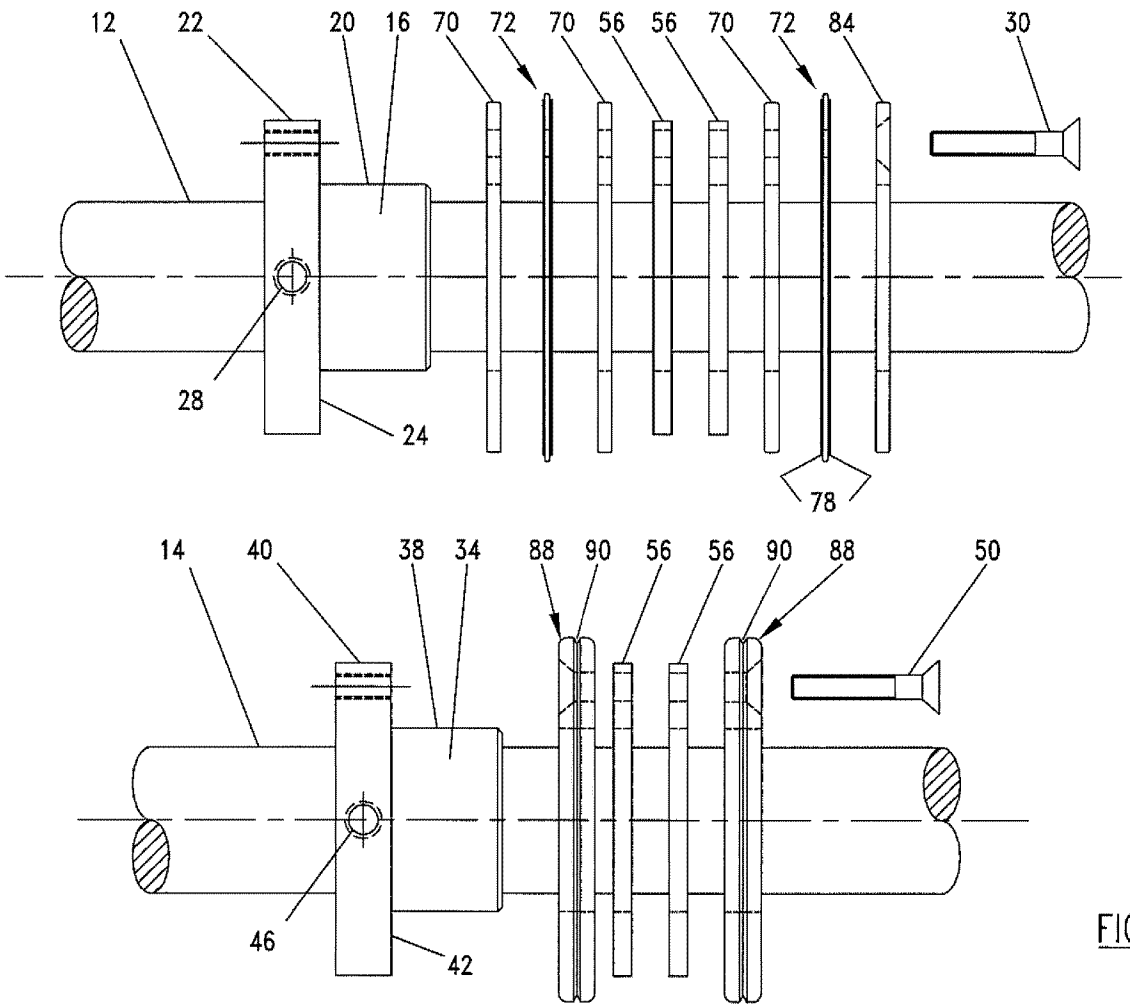
FIG. 2 is an exploded side view of the scoring system functioning as that shown in FIG. 1 with the components stacked in a different order than that in FIG. 1.
Figure 3:
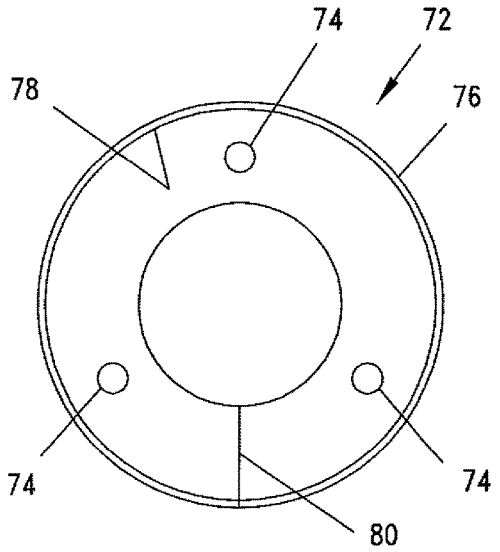
FIG. 3 is a front view showing a scoring disc.
Figure 4:
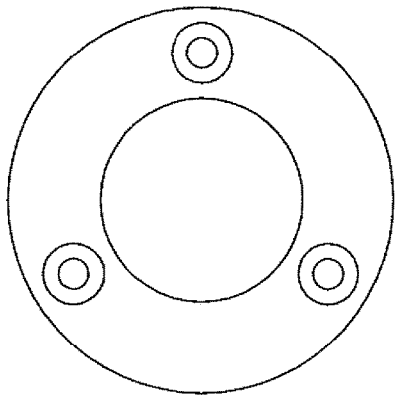
FIG. 4 is a front view showing a support disc.

The scoring head system 10 of this invention is shown in FIG. 1. FIG. 2 shows the system 10 in a side view as it would be assembled over a first shaft 12 and a second shaft 14. A first hub 16 has a bore 18 that receives the first shaft 12. The first hub 16 has a first outer diameter 20 and a second outer diameter 22. The second outer diameter 22 is larger than the first outer diameter 20 and forms a shoulder 24. The second outer diameter 22 includes a hole 28 for receiving a set screw (not shown) that may be tightened onto the first shaft 12. As such, the first hub 16 rotates with the first shaft 12. The shoulder 24 includes tapped holes 25 evenly spaced that are parallel to the axis of the first shaft 12. The holes 25 are adapted for receiving axial screws 30.

A second hub 34 has a bore 36 that receives the second shaft 14. The second hub 34 has a first outer diameter 38 and a second outer diameter 40. The second outer diameter 40 is larger than the first outer diameter 38 and forms a shoulder 42. The second outer diameter 40 includes a hole 46 for receiving a set screw (not shown) that may be tightened onto the second shaft 14. When the set screw is tightened, the second hub 34 will rotate with the second shaft 14. The shoulder 42 includes tapped holes 48 evenly spaced that are parallel to the axis of the second shaft 14. The holes 48 are adapted for receiving axial screws 50.

Figure 5:
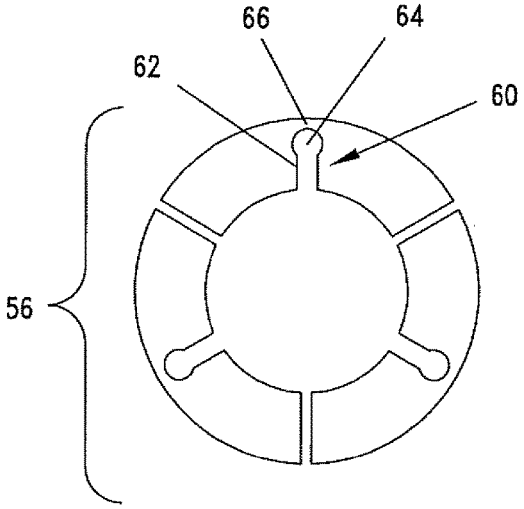
FIG. 5 is a front view showing a spacer with its segments.
Figure 6:
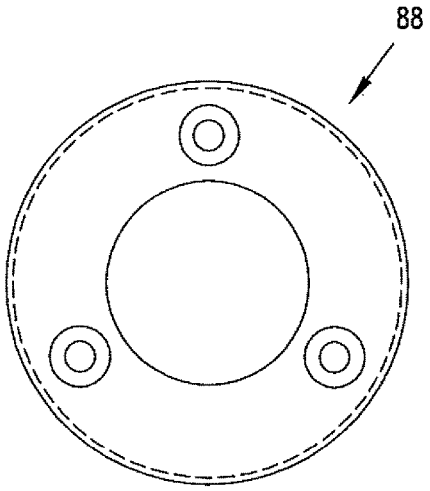
FIG. 6 is a front view of a receiving disc.
Figure 7:
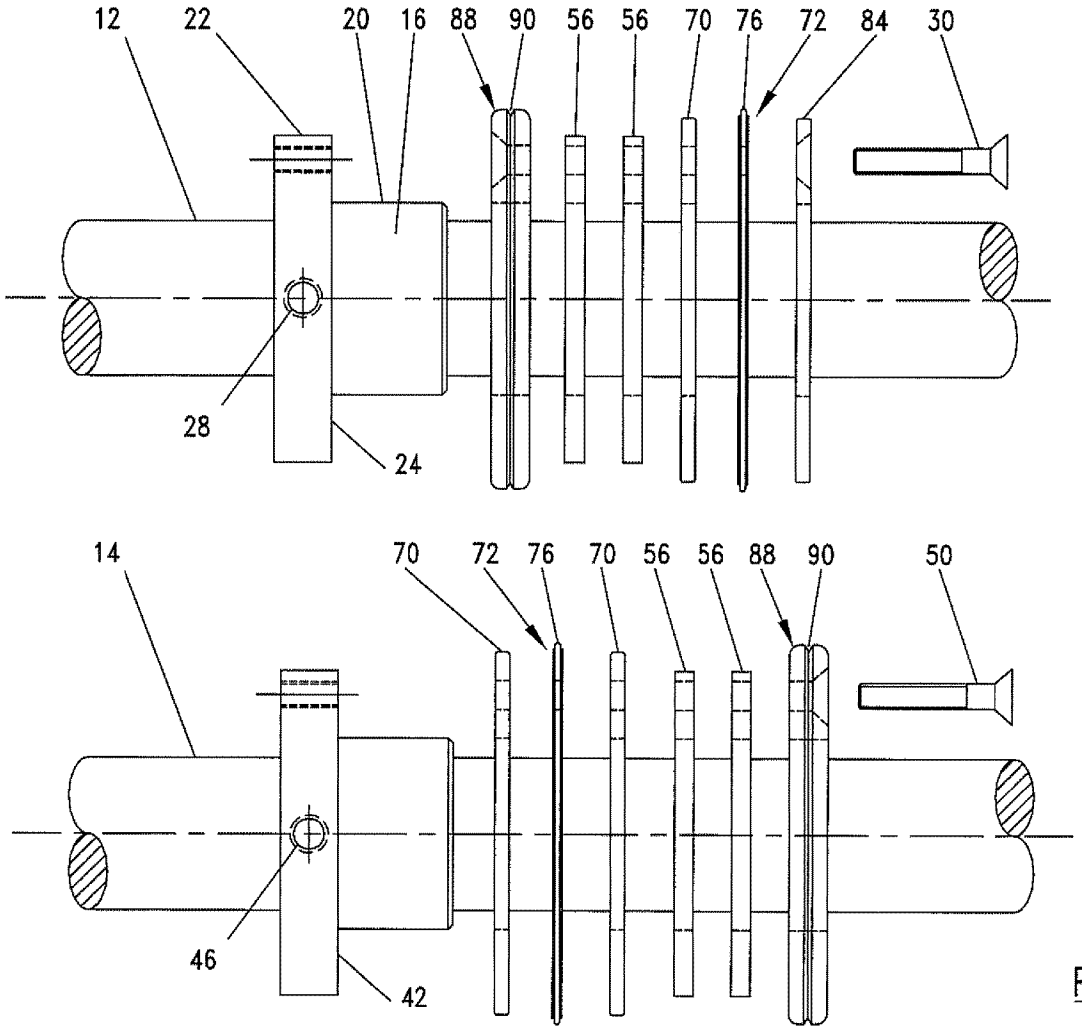
FIG. 7 is a side exploded view of the scoring system functioning as that shown in FIG. 2 with the components stacked in a different order than that of FIG. 2.

In FIG. 1, the first hub 16 being the upper hub may be stacked with components and the second hub 34 being a lower hub may be stacked with components. The order of the various components may be changed. At the leftmost side of the first hub 16 in FIG. 1 is a spacer 56. The spacer 56 is made of segments 58. FIG. 5 shows a spacer 56 and its three segments 58. Each segment 58 includes a keyhole 60 that has a slot 62 and a terminal hole 64. The terminal hole 64 is sized to approximately the same size as the outer diameter of the axial screws 30, 50. Because the slot 62 is slightly smaller than the outer diameter of the axial screws 30, 50 each segment 58 may be pressed radially onto a screw 30, 50 so that the screw 30, 50 rides in the slot 62 until it reaches the terminal hole 64. When the screw 30, 50 rides in the slot it flexes a bridge 66 that spans radially outwardly of the terminal hole 64, and when the screw 30, 50 reaches the terminal hole 64, the resilient bridge 66 snaps the slot 62 to its original size to that the segment 58 will be retained on the screw 30, 50 in a radial direction. Typically the spacer 56 is made of plastic which provides sufficient resiliency to provide the snap fit of the screw 30, 50 in the keyhole 60 as described above.

Adjacent to the spacers 56 in FIG. 1 is a support disc 70. A pair of support discs 70 straddle a scoring disc 72. The support discs 70 each include holes 74 to accommodate axial screws 30. The scoring disc 72 is an elastomeric material that has a raised profile 76 centrally located between shoulders 78. The raised profile 76 is shown as a radiused tip profile, but could also be an angled pointed profile as well, or triangular shape. The raised profile 76 stands proud of the support discs 70 and, depending on the desired configuration, the shoulders 78 adjacent to the raised profile 76 may also stand proud of the support discs 70. However, the shoulders 78 could be at or below the radial outmost diameters of the support discs 70. The scoring disc 72 has a slit 80 that allows the flexible scoring disc 72 to be bent so the slit 80 allows installation over the shaft 12. The support discs 70 retain the scoring disc 72 so that some radial compression is possible during scoring operations, yet the scoring disc 72 does not deform significantly in an axial direction. When the scoring discs 72 are installed between the support discs 70, there is no gap at the slit 80. As seen in FIG. 1, scoring discs 72 may be located on opposite sides of a single support disc 70'. It is possible to move support discs 70 to desired positions to reconfigure the locations of scoring discs 72 by removing and relocating spacers 56 without removing the shafts 12 from the scoring machine. An end cap disc 84 is shown in FIG. 1 at the far right of the hub 16. The end cap disc 84 can also serves as a support disc and has countersunk holes 86 that receive the axial screws 30.

The second hub 34 as shown in FIG. 1 is located oppositely of the first hub 16. Spacers 56 are stacked on the hub 34 to place a receiving disc 88 opposite a scoring disc 72. The receiving disc 88 has a groove 90 around its circumference. The receiving groove 90 in this case is triangle shaped, however, it is possible in some applications that other shapes such as rectangular receiving grooves or radiused bottom grooves may be used. Typically, the receiving groove 90 is sized at its outermost portion to be larger than that of the profile 76 of the scoring disc 72. The amount that the receiving groove 90 is larger than the profile 76 is chosen to accommodate the stock being scored. Generally, larger clearance between the profile 76 and receiving groove 90 is used for thicker stock being scored. A second receiving disc 88' is also placed to oppose the second scoring disc 72'. As shown in FIG. 1, the second receiving disc 88' serves as an end cap disc. Spacers 56, and support discs 70 maintain proper alignment of corresponding scoring discs 72 and receiving discs 88. When the spacers 56, support discs 70, and receiving discs 88 are properly placed in their desired locations; screws 30, 50 are tightened to fix their axial locations. Either the first or second hub 16, 34 may be moved axially on its shaft 12, 14 by loosening the set screw contained in hole 28, 46 and shifting it into a desired position. Once the hub 16, 34 is in its desired position, its respective set screw is tightened.

Figure 8:
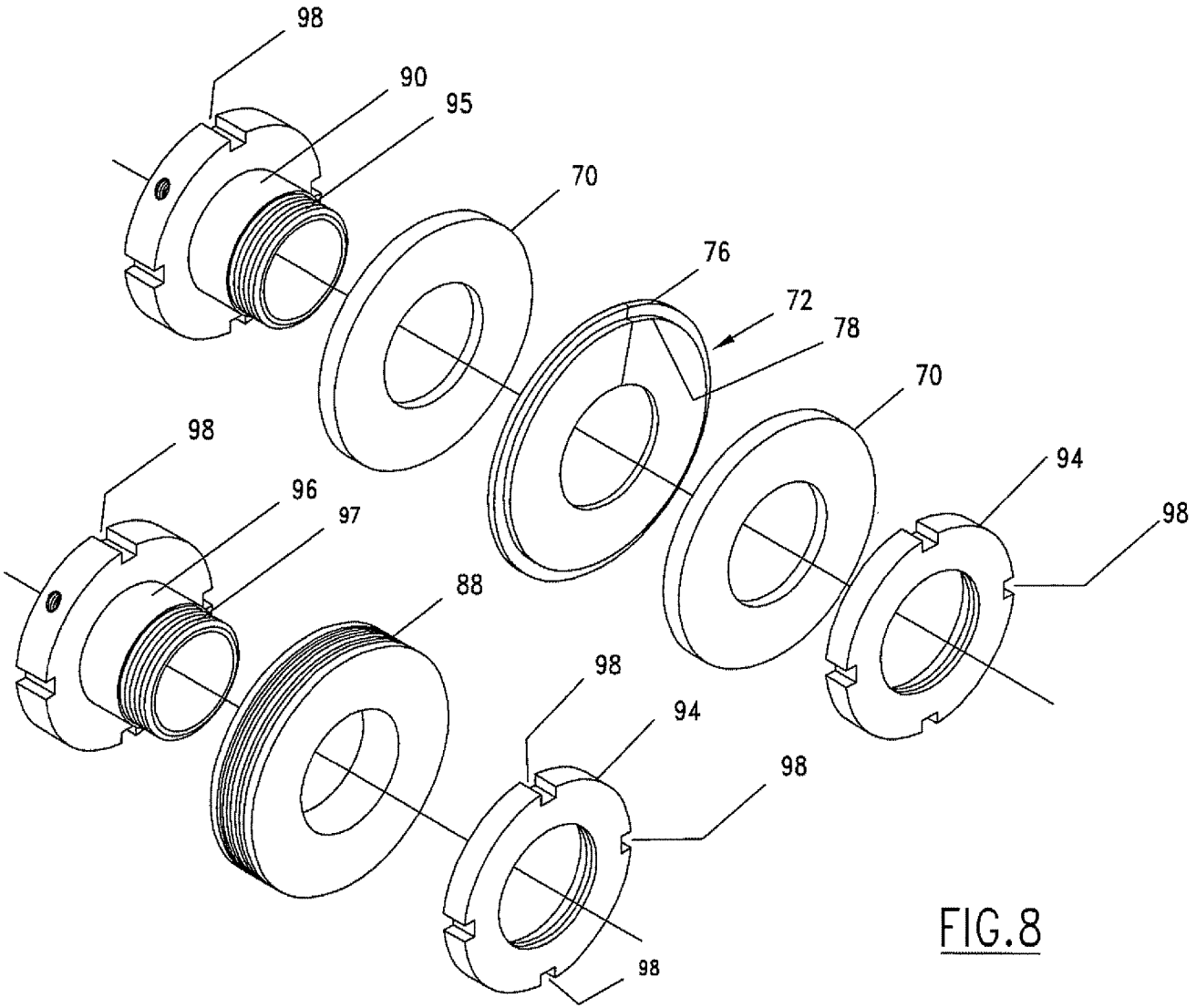
FIG. 8 is another embodiment of the scoring system using nuts to tighten components on the hubs.
Figure 9:
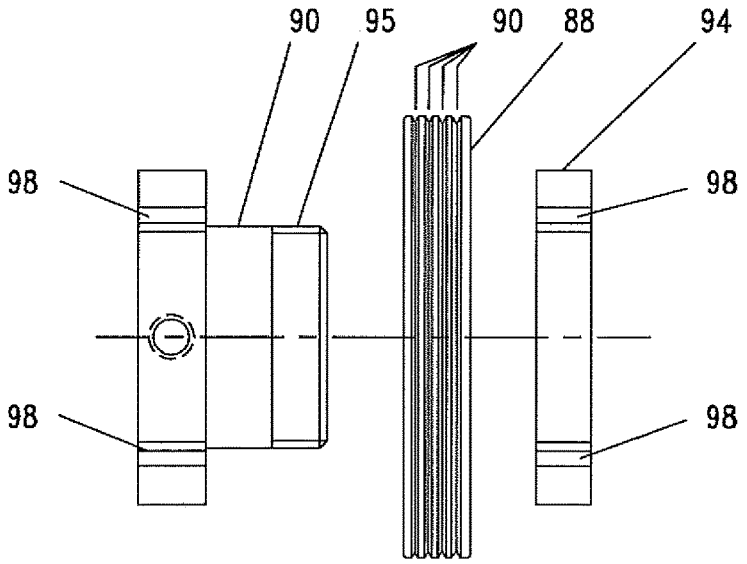
FIG. 9 is a side view showing a receiving disc on an hub like that in the embodiment shown in FIG. 8.
Figure 10:
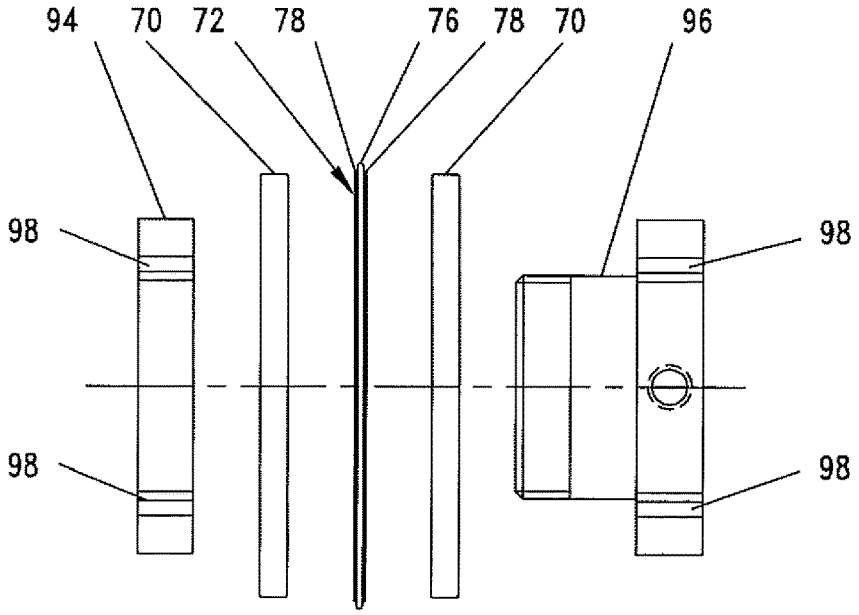
FIG. 10 is a side view showing a scoring disc between support discs on an hub like that in the embodiment shown in FIG. 8.
Figure 11:
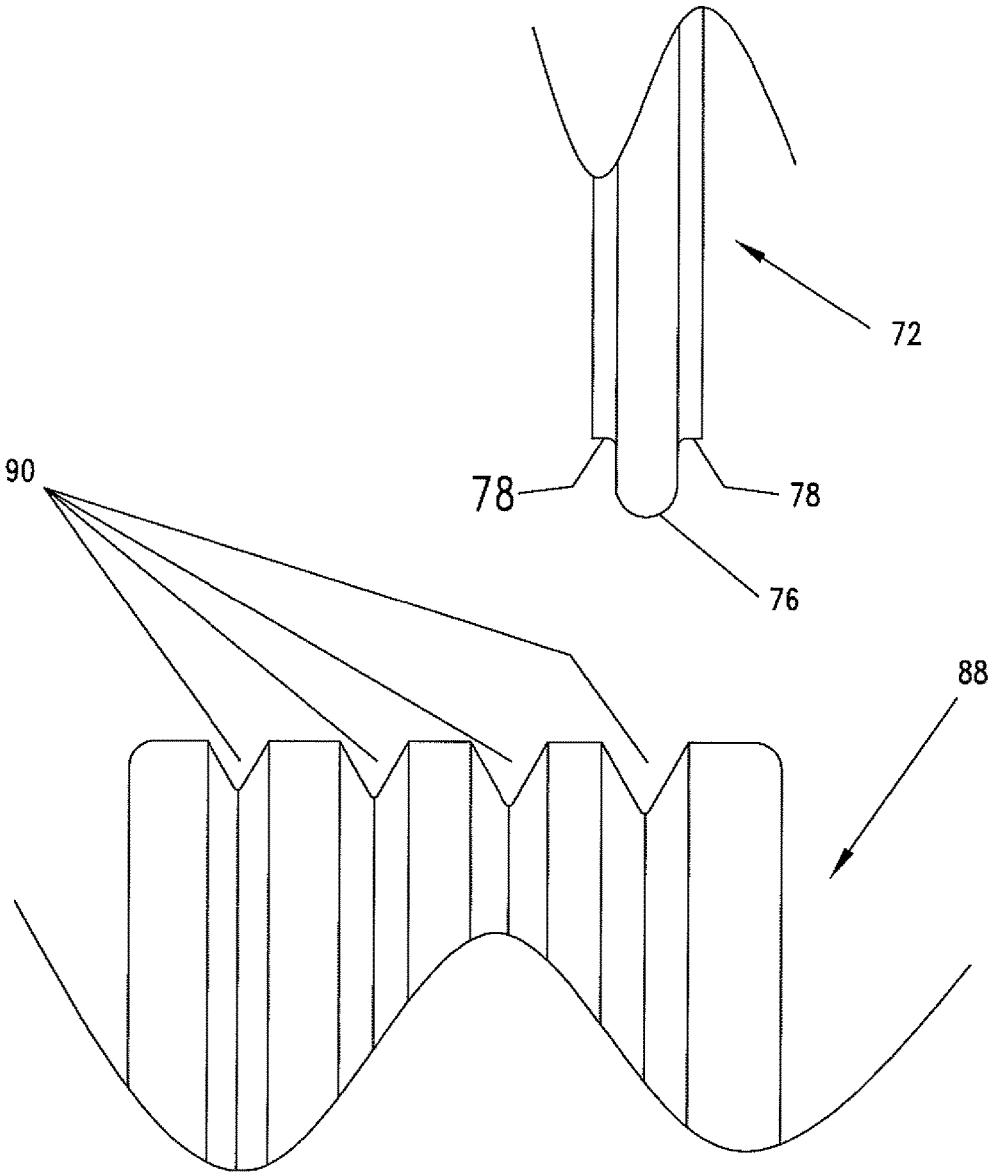
FIG. 11 is a magnified side view of a scoring disc and a grooved disc adjacent to each other.
Figure 12:
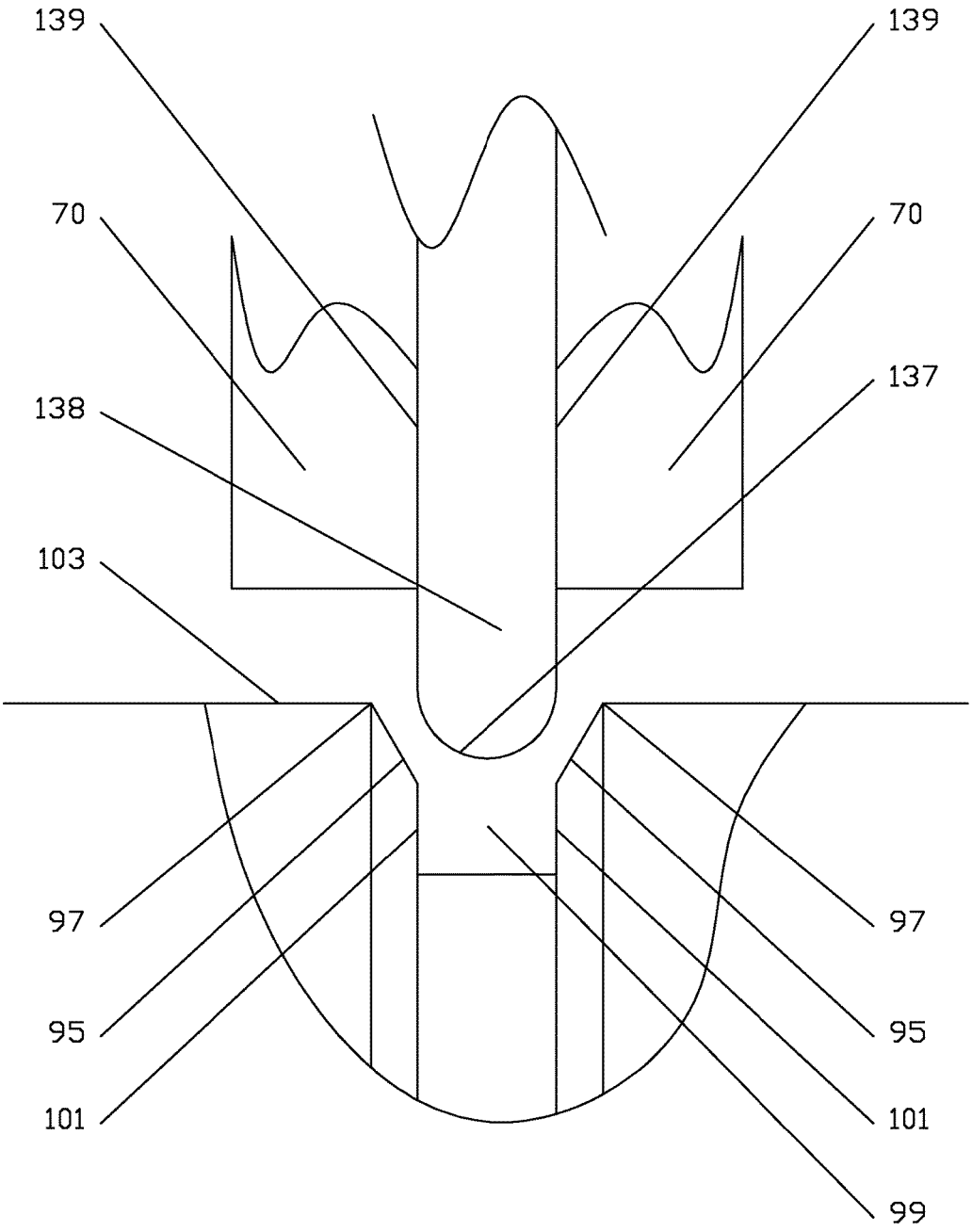
FIG. 12 is an view of a receiving creasing disc held between support discs located adjacent to a V-shaped groove.

Another way of fixing axial locations of various components may be done as shown in FIG. 8-10. In this case, a first hub 90 is formed in much the same way as first hub 16 of FIG. 1 is formed. However, instead of using axial screws 30 to retain components, a nut 94 is threaded onto a threaded portion 95 of the first hub 90. Likewise, a second hub 96 held opposite the first hub 90 is formed in the same manner. A nut 94 is threaded onto threaded portion 97 of the second hub 96. Each nut 94 and hub 90, 96 includes notches 98. The notches are for receiving a spanner wrench (not shown) that may extend into the notches 98 to tighten each nut 94 onto its respective hub 90, 96. Because no screws 30, 50 are used in the hubs 90, 96 it is not necessary to have holes in the components on the hubs 90, 96, but for standardization in manufacturing the spacers 56, support discs 72, and receiving discs 88 as shown in FIG. 1 could be used on the configuration shown in FIG. 8. In the embodiment shown in FIG. 8, it is also possible to shift either hub 90, 96 axial by loosening set screws and repositioning the entire hub 90, 96 axially along its respective shaft, 12, 14.

When a user of the scoring head system 10 of this invention wishes to reconfigure the system 10 this is easily done without removing shafts 12, 14 from the scoring machine. In the case of the embodiment shown in FIG. 1, the user will loosen the axial screws 30. The support discs 70 may be moved into their desired positions. If necessary, the scoring discs 72 may be moved by removing the screws 30 and by flexing the disc 72 to open the slit 80 so that it may be removed from its shaft 12. When the scoring discs 72 and support discs 70 are in their desired order, screws 30 may be loosely threaded into their holes 25. Spacer segments 58 may then be snapped onto the screws 30 to set the final location of the scoring discs 72. Once the spacers 56 are placed, the screws 30 may then be tightened. Opposite the scoring discs 72, spacing of the receiving disc(s) 88 will need to be aligned with a corresponding scoring disc 72. This is done by placing spacers 56 in appropriate locations to position receiving discs 88 properly. Then the screws 50 are tightened. When the configuration on both shafts 12, 14 are locked in place with the screws 30, 50, paper, may be scored.

FIGS. 12-15 show the system 10 of the invention that includes a first hub 92 that has a receiver disc 93 having multiple grooves 94 within it. The grooves 94 of the receiver disc 93 have a V-shaped portions 95 that are located between outermost edges 97 of the grooves 94. The V-shaped portions 95 flank a relatively deeper relief groove 99 having sides 101 that are perpendicular to the outer surface 103 of the receiver disc 93. The first hub has a bore 91 is adapted put on the first shaft 12 of the creasing machine. The first hub 92 includes a first diameter 96 that is adjacent to a larger second diameter 98 that forms a shoulder 100. The first diameter 96 includes threads 102. A nut 104 is designed to be threaded on the threads 102 of the first hub 92. The second diameter 105 includes holes 106 that are adapted to receive a spanner wrench (not shown) and the nut 104 also includes holes 108 that are adapted to receive a spanner wrench for tightening the nut onto the threads 102. Tightening the nut 104 onto the threads 102 generates a clamping force that holds the receiver disc 93 onto the shoulder 100. The first hub 92 along with the receiver disc 93 and nut 104 are fixed to the first shaft 12 using set screw 110.

Figure 15:
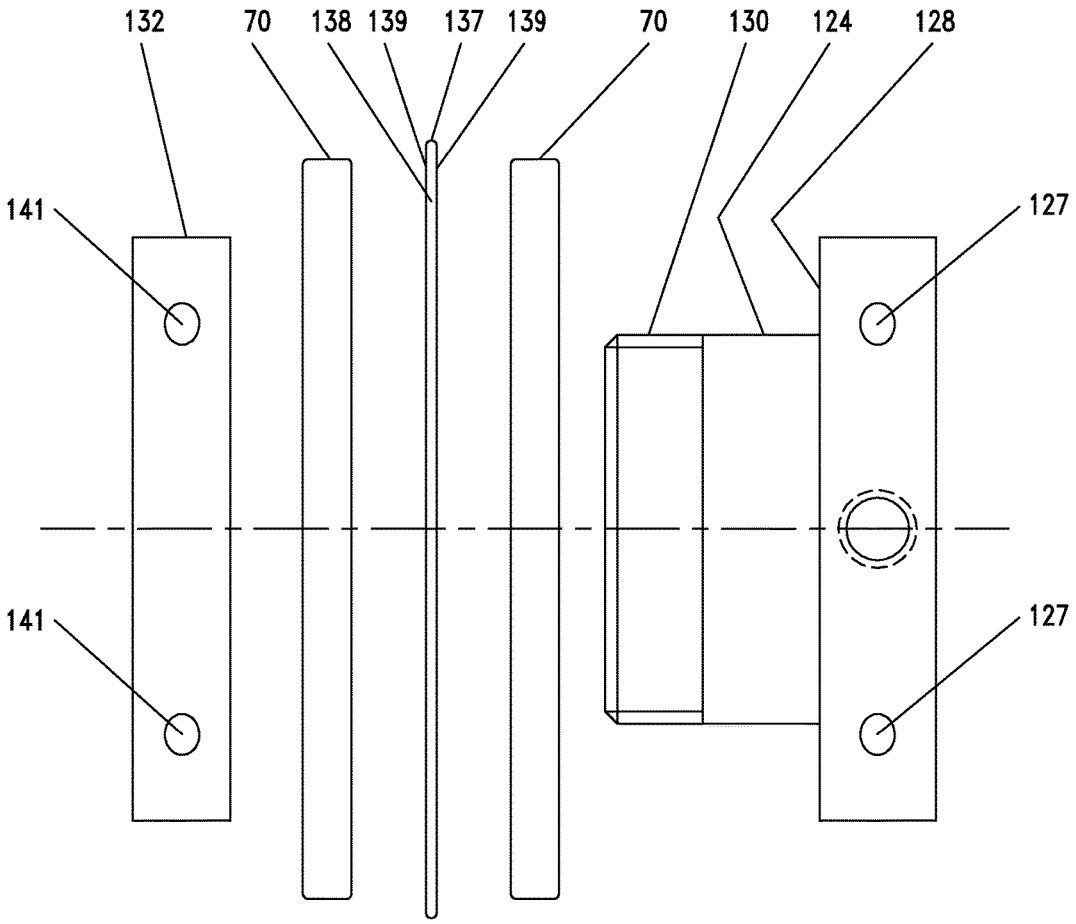
FIG. 15 is an exploded view of a creasing disc that is adjacent to its corresponding hub to which it will be mounted along with support discs that will straddle the creasing disc.
Figure 16:
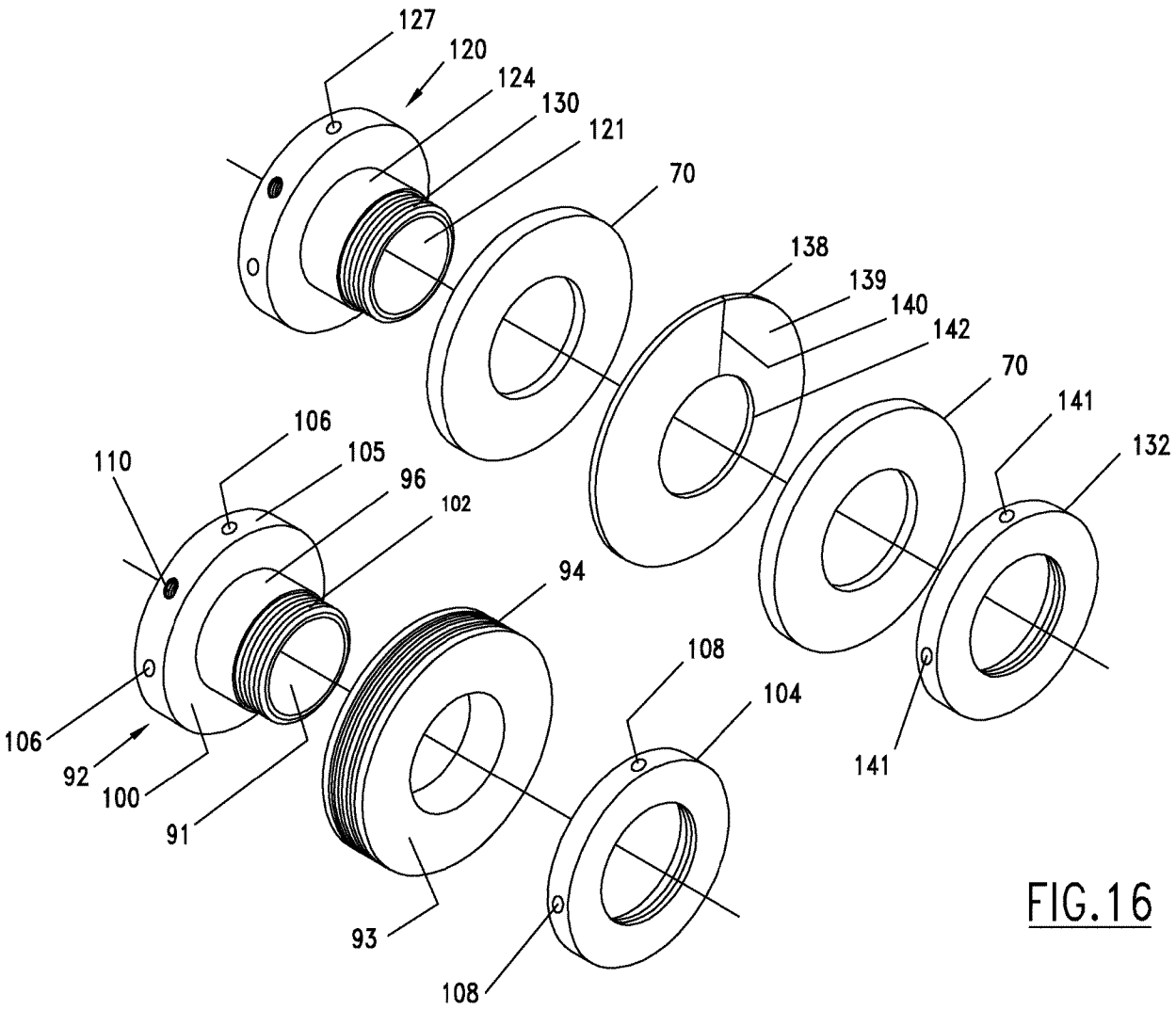
FIG. 16 is an exploded view of opposing hubs that will hold a creasing disc and receiving disc that are respectively shown in FIG. 15 and FIG. 14.

FIG. 16 shows a second hub 120 located oppositely to the first hub 92 having a bore 121 adapted to be installed on the second shaft 14 of the creasing machine. The second hub 120 includes a first diameter 124 that is adjacent to a larger second diameter 126 that forms a shoulder 128. The first diameter 124 includes threads 130. Nut 132 is designed to be threaded on the threads 130 of the second hub 120. The second diameter 126 includes holes 127 that are adapted to receive a spanner wrench. The second hub 120 is also adapted to receive support discs 70. The support discs 70 are adapted to be received on the first diameter 124 and straddle a creasing disc 138. The creasing disc 138 is an elastomeric material. Nut 132 has holes 141 that are adapted to receive a spanner wrench. Tightening the nut 132 onto the threads 130 generates a clamping force on the creasing disc 138 that holds the support discs 70 and creasing disc 138 onto the second hub 120, against the shoulder 128. The creasing disc 138 has a portion that stands proud of the support discs 70 when they are on the second hub 120. The creasing disc 138, shown in FIGS. 13, and 14-16 has a constant width and is rounded into an end radius 137 as shown in FIG. 15. The creasing disc 138 has two annular, flat and parallel faces 139 that extend from a central aperture 142 to where the radius at the outer diameter begins. The creasing disc 138 has no shoulder and the maximum amount of the creasing disc 138 that is exposed between the support discs 70 is the width of the creasing disc 138 defined by the distance between the faces 139. Every part of the creasing disc 138 fits between the axial exposed distance defined by the distance between faces 139. In other words, no undercut is present in the creasing disc 138 before or after it is installed between support discs 70. This thin exposed distance being equal to the distance between the support discs 70 allows great flexibility in changing configuration of a creasing machine and enables profiles of thin creasing discs 138 that have a single radius at their outer diameter. Because the creasing disc 138 has a large area between its central aperture 142 and its outer diameter, a relative low clamping force is necessary compared to the use of a small diameter ring near the outer surface of the support discs 70. As such clamping the creasing disc 138 with sufficient clamping force to keep it in place will not significantly deform the creasing disc 138. The creasing disc 138 has a slit 140 that extends from its central aperture 142 to its outermost surface. The slit creasing disc 138 is adapted to be bent adjacent to its slit 142 and slid over the shaft 14 or 16 onto which it circumscribes after being removed from its corresponding hub. This enables removal of the creasing disc 138 without removing the corresponding shaft 14, 16 from the creasing machine.

Figure 13:
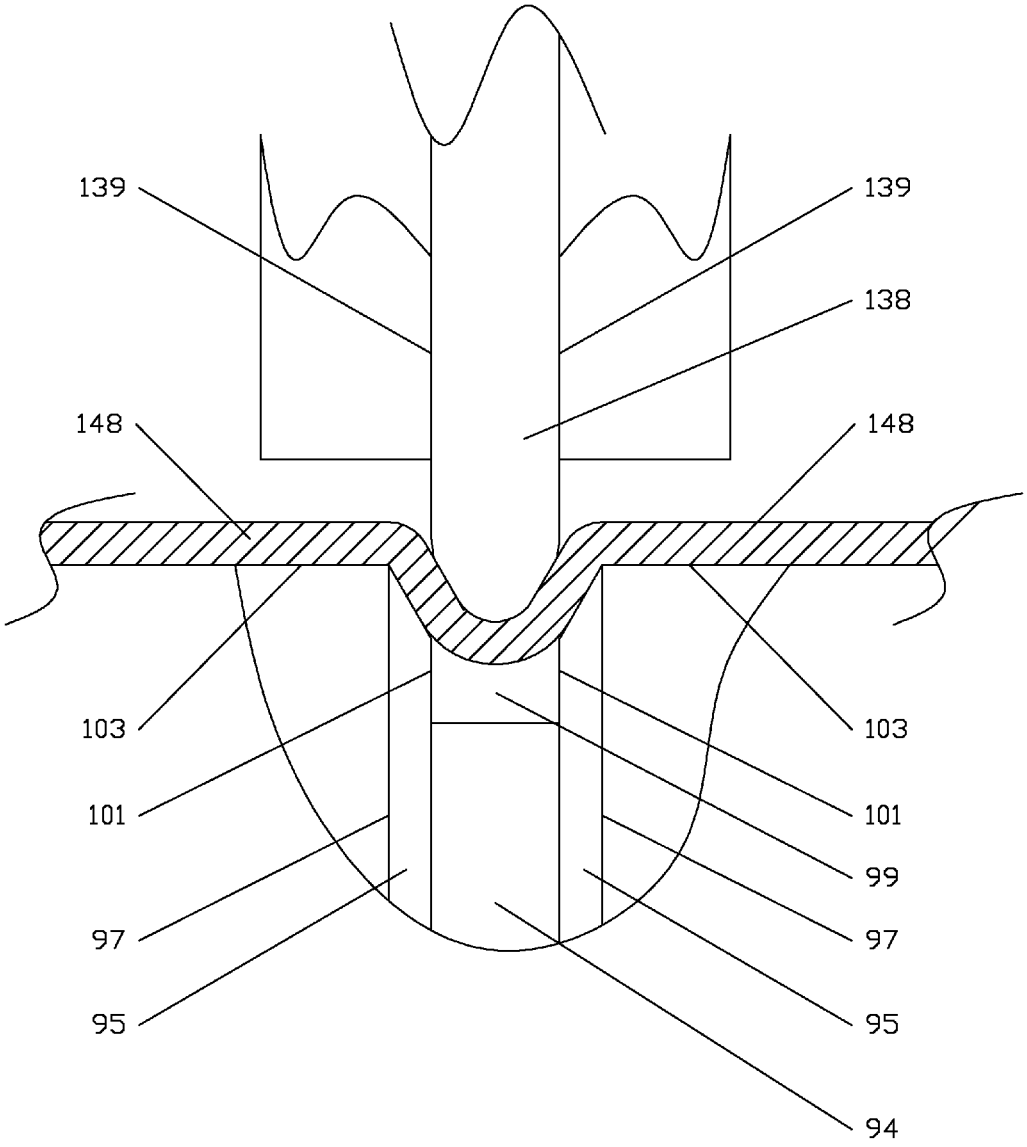
FIG. 13 is a view of the creasing disc shown in FIG. 12 with stock to be creased between the creasing disc and the V-groove.
Figure 14:
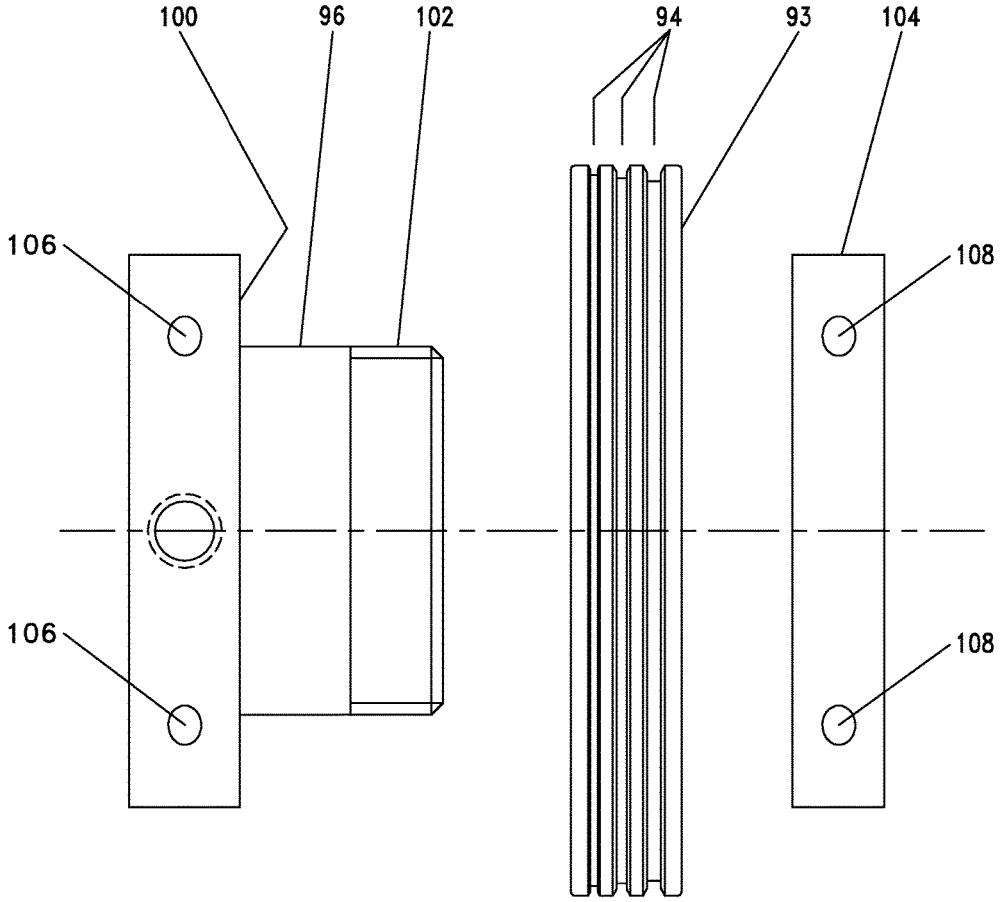
FIG. 14 is an exploded view of a receiving disc adjacent to its corresponding hub to which it will be mounted.

During use of the creasing system 10 shown in FIG. 13, paper 148 or other stock to be creased will be placed between the creasing disc 138 and one of the selected grooves 94 on the receiver disc 93. The support discs 70 extend to near the start of the end radius 137 of the creasing disc 138 and as such, the creasing disc 138 can create a crisp score without cracking the paper 148. The flat parallel annular faces 139 continue directly into the end radius 137 without a shoulder or other interrupting feature between annular faces 139 and the end radius 137. As such, only the end radius 137 and the outermost surface extend beyond the support discs 70. Because the creasing disc 138 is made of an elastomeric material, it will flow to some degree within the groove 94 opposite to it. As shown in FIG. 13, a gradual creasing of the paper 148 will occur that does not cause a sharp rise in surface tension on the side opposite the creasing disc 138. The paper 148 is gently rolled against the V-shaped portions 95 of the groove 94 which act as opposing support to the creasing disc 138 and the paper 148 is held over an unsupported area corresponding to where the paper 148 is located over the relief groove 99. The angled support surfaces of the V-shaped portions 95 help the creasing disc 138 drive the paper through the creasing machine without any traction surface other than the end radius 137 contacting the paper 148 and pushing against the supporting V-shaped portions 95. This minimal contact with the paper 148 ensures that the likelihood of cracking on fragile coated paper will be minimized and directs that the crease will fall directly between the support discs 70 in a predictable and controlled manner. The thin axial exposed distance ensures a straight crease, unlike a wider creasing disc with a step, which would lack full guidance of the rigid support discs 70. Because the creasing disc 138 has no undercut, and thus, no part extending axially beyond the exposed distance set by the spacing between support discs 70, it is much more stable than an undercut disc lacking such support. No part of the creasing disc 138 extends axially beyond the V-shaped portions 95 defining the axial boundaries of the groove 94 when the creasing disc is centered with respect to its corresponding opposing groove 94. The relief groove 99 can be of any depth sufficient to leave a gap between the surface of the paper 148 being pushed into the groove 94 and the bottom of relief groove 99. This ensures that dust or debris that may accumulate during operation will not clog the relief groove 99, which would diminish the effectiveness of the creasing operation.

The invention is not limited to the details given above, but may be modified within the scope of the following claims.

What is claimed is:

1. A creasing device for creasing sheet stock comprising:

a first hub including a bore for receiving a first shaft, said hub having a first outer diameter and a second outer diameter larger than said first outer diameter defining a shoulder;

a second hub including a bore for receiving a second shaft that is substantially parallel and spaced from said first shaft, said second hub having a first outer diameter and a second outer diameter larger than said first outer diameter defining a shoulder;

a support disc having a bore for fitting over said first outer diameter in aligned contact with said first outer diameter of said one hub;

a second support disc having a bore for fitting over said first outer diameter in aligned contact with said first outer diameter of said one hub;

a creasing disc made from an elastomeric material having an aperture for fitting over said first outer diameter of one of said hubs, said creasing disc including a first annular planar surface and a second annular planar surface, said first and second annular planar surfaces being substantially parallel, said creasing disc including a slit extending from said aperture to an outer diameter of said creasing disc, and said creasing disc for being held between said first and second support discs, each of said support discs having an outer diameter and each of said support discs including an inner diameter, said inner diameters of said support discs fitting over said first outer diameter of said one hub, said inner diameter of said creasing disc being substantially the same as said support discs, said creasing disc including a raised profile standing radially outward of said support discs;

a grooved disc having a bore for being received upon another of said hubs, said grooved disc including a circumferential groove for receiving a portion of sheet stock pressed into said groove when said creasing disc is located adjacent to and opposite said groove, said groove including V-shaped portions defining outer edges of said groove, said V-shaped portions flanking a relief groove within said circumferential groove having sides extending inwardly within the grooved disk, said sides of said relief groove being substantially perpendicular to an outer surface of said grooved disc and said V-shaped portions of said circumferential groove being obliquely angled with respect to said outer surface of said grooved disc;

a nut for clamping said support discs onto their corresponding said one hub, said nut opposite said shoulder and said nut generating a clamping force, which provides the sole clamping force for clamping said creasing disc between said support discs, and said nut circumscribing a portion of said one hub; and a second nut for clamping said grooved disc to its corresponding said another hub, said second nut circumscribing a portion of said another hub.

2. The creasing device as claimed in claim 1, said creasing disc including an end radius having a portion extending radially outward of said support discs, said annular planar surfaces of said creasing disc directly transitioning into said end radius.

3. The creasing device as claimed in claim 2, wherein said support discs contact a majority of said annular planar surfaces of said creasing disc.

4. The creasing device as claimed in claim 1, having an exposed axial distance defined by the spacing between said support discs when clamping said creasing disc, said creasing disc being completely contained within said exposed axial distance.

5. The creasing device as claimed in claim 4, wherein said annular surfaces do not extend beyond said outer edges of said groove when said creasing disc is centered with respect to said groove located oppositely thereof.

6. A creasing device for creasing sheet stock comprising:

a first hub including a bore for receiving a first shaft, said hub having a first outer diameter and a second outer diameter larger than said first outer diameter defining a shoulder;

a second hub including a bore for receiving a second shaft that is substantially parallel and spaced from said first shaft, said second hub having a first outer diameter and a second outer diameter larger than said first outer diameter defining a shoulder;

a support disc having a bore with an inner diameter for fitting over said first outer diameter of one of said hubs;

a second support disc having a bore with an inner diameter for fitting over said first outer diameter of said one hub;

a creasing disc made from an elastomeric material having an aperture including an inner diameter for fitting over said first outer diameter of said one hub, said creasing disc including a first annular planar surface and a second annular planar surface, said first and second annular planar surfaces being substantially parallel, said creasing disc including a slit extending from said inner diameter of said creasing disc to said outer diameter of said creasing disc, and said creasing disc for being held between said first and second support discs when said inner diameters of said support discs are fitted over said first outer diameter of said one hub, said creasing disc including a raised profile standing radially outward of said support discs when clamped therebetween a portion of said raised profile including said end radius, an axial exposed distance between said support discs being established by a thickness of said creasing disc said support discs when clamping said creasing disc, no part of said creasing disc extending axially beyond said axial exposed distance;

a grooved disc having a bore for being received upon said another of said hubs, said grooved disc including a circumferential groove for receiving a portion of sheet stock pressed into said groove when said creasing disc is located adjacent to and opposite said groove;

a nut for clamping said support discs onto their corresponding said one hub, said nut opposite said shoulder and said nut generating a clamping force which provides the sole clamping force for clamping said creasing disc between said support discs, and said nut circumscribing a portion of said one hub; and a second nut for clamping said grooved disc to its corresponding hub, and said second nut circumscribing a portion of said another hub.

7. The creasing device as claimed in claim 6, wherein said groove includes V-shaped portions defining outer edges of said groove, said V-shaped portions of said circumferential groove being obliquely angled with respect to said outer surface of said grooved disc said V-shaped portions flanking a relief groove within said circumferential groove having sides extending inwardly within the grooved disk, said sides of said relief groove being substantially perpendicular to an outer surface of said grooved disc.

8. A creasing device for creasing sheet stock comprising:

a first hub including a bore for receiving a first shaft, said hub having a first outer diameter and a second outer diameter larger than said first outer diameter defining a shoulder;

a second hub including a bore for receiving a second shaft that is substantially parallel and spaced from said first shaft, said second hub having a first outer diameter and a second outer diameter larger than said first outer diameter defining a shoulder;

a support disc having a bore with an inner diameter for fitting over said first outer diameter of one of said hubs;

a second support disc having a bore with an inner diameter for fitting over said first outer diameter of said one hub;

a creasing disc made from an elastomeric material having an aperture including an inner diameter for fitting over said first outer diameter of said one hub, said creasing disc including a first annular planar surface and a second annular planar surface, said first and second annular planar surfaces being substantially parallel, said creasing disc including a slit extending from said inner diameter of said creasing disc to an outer diameter of said creasing disc, and said creasing disc for being held between said first and second support discs, said creasing disc including a raised profile standing radially outward of said support discs when clamped therebetween a portion of said raised profile including said end radius, an axial exposed distance between said support discs being established by a distance between said support discs when clamping said creasing disc, no part of said creasing disc extending axially beyond said axial exposed distance;

a grooved disc having a bore for being received upon said another of said hubs, said grooved disc including a circumferential groove for receiving a portion of sheet stock pressed into said groove when said creasing disc is located adjacent to and opposite said groove;

a nut for clamping said support discs onto their corresponding said one hub, said nut opposite said shoulder and said nut generating a clamping force which provides the sole and said nut, said clamping force for clamping said creasing disc between said support discs, and said nut circumscribing a portion of said one hub; and a second nut for clamping said grooved disc to its corresponding hub, and said second nut circumscribing a portion of said first diameter of said another hub.

9. The creasing device as claimed in claim 8, said creasing disc is completely contained within said exposed axial distance.

10. The creasing device as claimed in claim 9, wherein said annular surfaces do not extend beyond said outer edges of said groove when said creasing disc is centered with respect to said groove located oppositely thereof.

11. The creasing device as claimed in claim 8, wherein said inner diameter of said creasing disc is substantially the same as said support discs.

* * * * *